US007017202B1

(12) United States Patent
Chisholm

(10) Patent No.: US 7,017,202 B1
(45) Date of Patent: Mar. 28, 2006

(54) BUNK BED PANEL

(76) Inventor: Seth J. Chisholm, 20 Waban Ave., Worcester, MA (US) 01604

( * ) Notice: Subject to any disclaimer, the term of this patent is extended or adjusted under 35 U.S.C. 154(b) by 0 days.

(21) Appl. No.: 11/128,967

(22) Filed: May 13, 2005

Related U.S. Application Data

(60) Provisional application No. 60/571,707, filed on May 17, 2004.

(51) Int. Cl.
*A47C 19/22* (2006.01)
*A47C 31/00* (2006.01)

(52) U.S. Cl. ..... 5/9.1; 5/658; 5/907

(58) Field of Classification Search ..... 5/8, 5/9.1, 658, 907, 922
See application file for complete search history.

(56) References Cited

U.S. PATENT DOCUMENTS

| | | | | |
|---|---|---|---|---|
| 3,877,086 | A * | 4/1975 | Bue et al. | 5/9.1 |
| 4,900,604 | A * | 2/1990 | Martinez et al. | 428/79 |
| 5,196,246 | A * | 3/1993 | Kauss et al. | 428/39 |
| 5,491,006 | A * | 2/1996 | Johnson et al. | 428/13 |
| 5,502,849 | A * | 4/1996 | Mitchell | 5/9.1 |
| 5,903,938 | A | 5/1999 | Padilla | |
| 6,627,284 | B1 * | 9/2003 | Naidj | 428/40.1 |
| 2005/0050633 | A1 * | 3/2005 | Rogers | 5/9.1 |

* cited by examiner

*Primary Examiner*—Robert G. Santos
(74) *Attorney, Agent, or Firm*—Blodgett & Blodgett, P.C.

(57) ABSTRACT

A cover furnishing, generally made of a single continuous piece of rectangular plastic or suitable material affixed to cover and conceal the underside of a top bunk or loft bed system to prevent particles from falling from the mattress or on a ceiling above the top bed. The board may depict characters, designs, artwork, textures, photographs or any other desired designs imaged onto the board via current acceptable printing processes.

10 Claims, 4 Drawing Sheets

BUNK BED PANEL

CROSS-REFERENCE TO RELATED APPLICATIONS

This application claims the benefit under 35 U.S.C. §119 (e) of U.S. Provisional Application No. 60/571,707 filed May 17, 2004, which is hereby incorporated by reference.

STATEMENT REGARDING FEDERALLY SPONSORED RESEARCH OR DEVELOPMENT

This invention has been created without the sponsorship or funding of any federally sponsored research or development program.

BACKGROUND OF THE INVENTION

This invention is a furnishing for use in conjunction with a bunk or loft bed. In most cases, the arrangement of a bunk bed includes separated slats which support the underside of the mattress in the upper bunk. The underside of the mattress in the upper bunk is exposed and is positioned above the occupant of the lower bunk. Mattresses tend to foster and produce common household dust mites and asthma/allergy/hay fever causing material that generally falls from the exposed underside of the top bunk bed or loft bed mattress, and to showers down upon the occupant of the lower bunk. This showering of particles can be a serious problem for lower bunk occupants with asthma and/or allergies to dust-mites, pollens, animal dander, mold/mildew. Researchers from the Universitat Rovira I Virgili in Tarragona, Spain, has determined that sleeping in the bottom bed of a bunk may increase the risk of developing asthma. The bottom bunk exposes the sleeper to higher amounts of household dust mites and dust mite allergens, which fall from the bedding of the top bunk as its occupant's moves during sleep.

These and other difficulties experienced with the prior art devices have been obviated in a novel manner by the present invention.

It is, therefore, an outstanding object of the present invention to provide a bunk bed system and furnishing which effectively reduce the exposure of lower bunk occupants to dust-mites, pollens, animal dander, mold/mildew, or other particles that cause or trigger asthma and/or allergic reactions.

Another object of this invention is to provide a bunk bed system and furnishing that is easy and simple to install.

A further object of the present invention is to provide a bunk bed system and furnishing that is convenient to transport.

It is another object of the invention is to provide a bunk bed system and furnishing which enhances the aesthetic and psychological environment of the lower bunk.

It is a further object of the invention to provide a bunk bed system and furnishing which is capable of being manufactured of high quality and at a low cost, and which is capable of providing a long and useful life with a minimum of maintenance.

With these and other objects in view, as will be apparent to those skilled in the art, the invention resides in the combination of parts set forth in the specification and covered by the claims appended hereto, it being understood that changes in the precise embodiment of the invention herein disclosed may be made within the scope of what is claimed without departing from the spirit of the invention.

BRIEF SUMMARY OF THE INVENTION

This invention is a cover for the underside of a bunk or loft bed system or a screen to be attached to the ceiling above the top bed. The cover is generally comprised of a frameless single continuous piece of rectangular plastic or suitable material 37" wide and 76" long, the typical width and length of standard bunk and loft systems. It will be no less than 2 mm thick and no more than 4 mm thick. The corners of the board will be rounded to avoid any possible injuries.

The cover may depict characters, designs, artwork, textures, photographs or any other desired designs imaged onto the board via current acceptable printing processes.

The some of the purposes of the visual aspect of this invention are possibly assist in the psychological disorder of claustrophobia, lulling sleep aid, study and educational aid, advertisement possibilities, aesthetic appeal, comfort environment for bed occupant, and cosmetic appeal for the actual bunk/loft bed assembly.

The purpose of plastic material usage involves a non-permeable barrier to common household dust mites and asthma/allergy/hay fever causing material that generally falls from the underside of the top bunk bed or loft bed. The cover prevents particles from falling from the mattress on to the occupant of the lower bunk. Of particular importance are particles that cause or trigger asthma and allergies to dust-mites, pollens, animal dander, mold/mildew. Said cover can eliminate this need.

The cover will be attached to the underside of the top bed or loft bed or ceiling by 24 individual 1⅞" Hook and Loop Coins or other suitable attachment methods.

The cover will be slit scored on the reverse image side in two places for foldable purposes.

As seen in the foregoing description, this is an extremely simple, affordable and visually stimulating method to cover the underside of a top bunk or loft system or to be attached to the ceiling above the top bunk. The cover aides in visual aspects and health aspects of bunk and loft bed occupants as well. The detailed description above is to be taken in conjunction with the drawings in which was illustrated, by the way of example, the principles of the invention.

BRIEF DESCRIPTION OF THE DRAWINGS

The character of the invention, however, may best be understood by reference to one of its structural forms, as illustrated by the accompanying drawings, in which.

DETAILED DESCRIPTION OF THE INVENTION

Figure 2:
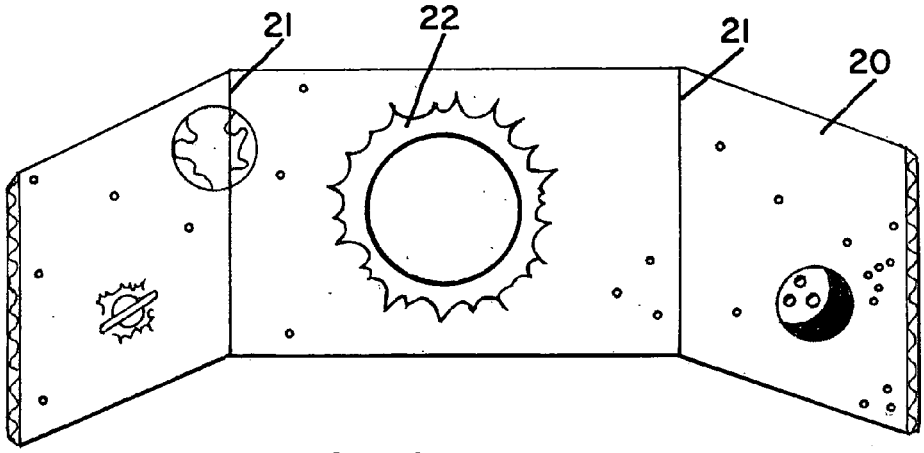
FIG. 2 is a perspective view of a foldable cover to be attached underneath the upper bunk mattress according to the present invention.

As shown in the drawings for purposes of illustration, the present invention is concerned with a furnishing or cover for the underside of a top bunk bed, loft bed system or ceiling. As shown in FIG. 2, the material consists generally of a rectangular shape comprised of plastic or suitable material.

A rectangular rigid panel approximately 37" Wide by 76' Long is affixed to the furnishing by methods of fastening, such as be utilizing corresponding hook and loop elements commercially known by the trademark VELCRO or other suitable hook and loop elements. Thus a method of covering the bottom of the top bed in a bunk bed or loft bed system or ceiling is described. Broadly, the method comprises the steps of providing a rectangular rigid panel of plastic or suitable material and attaching said furnishing to the bottom of the top bed of a bunk bed, loft bed system or ceiling. The rigid panel may be formed from any suitable and lightweight material, such as plastic, and may be embellished with designs, artwork, or characters, textures which are pleasing to the eyes and may act to soothe and comfort the child occupant of the lower bunk bed, loft bed or ceiling area. For example, if the occupant of the lower bunk bed is a child, a picture of his or her favorite cartoon character or athlete may be printed on the rigid panel. With the present invention, the rigid panel may be easily removed and replaced by another rigid panel with a different design.

Figure 1:
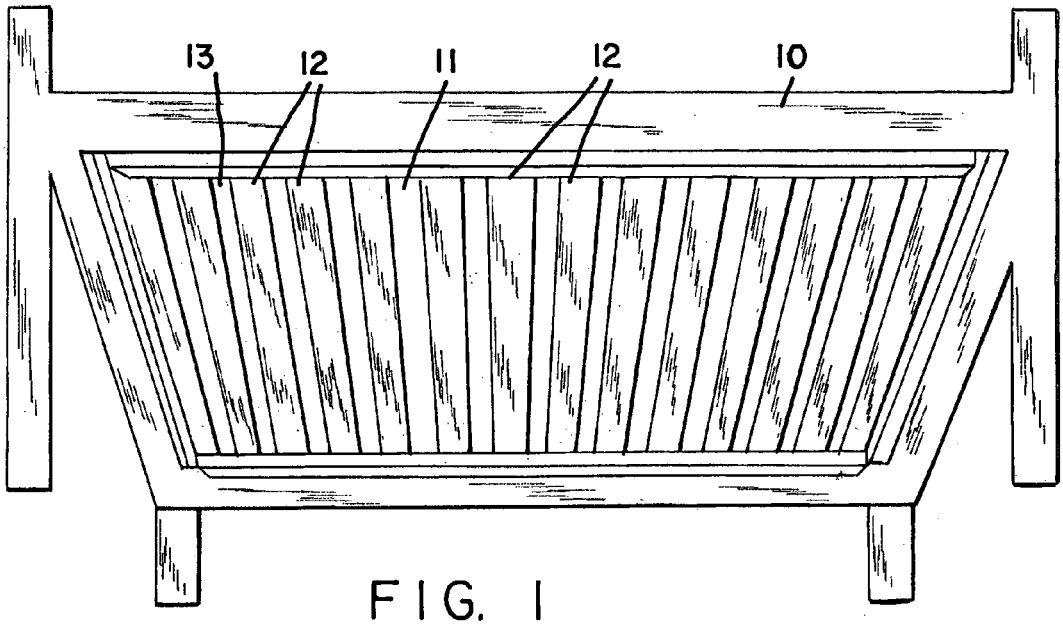
FIG. 1 is a perspective view, from below, of a furnishing such as an upper bunk, showing the separated slats and mattress.

Referring to FIG. 1–4 in which the general principles of the present invention are shown, FIG. 1 is a prospective view of the upper bunk 10 of a bunk bed, as seen from below. The upper bunk 10 includes a mattress 11 which is supported on its lower surface 13 by separated slats 12. The spaces between the slats 12 allow particles from the mattress 11 to fall from the lower surface 13 of the mattress 11 into the lower bunk space which is below the upper bunk 10.

FIG. 2 shows a foldable cover 20 of approximately the same area size as the lower surface 13 of the mattress 11. The cover 20 is adapted to cover the lower surface 13 of the mattress 11. The cover 20 includes hinged elements 21 which allow the cover to be folded to reduce its area, for convenience in storage and transport. One or both sides of the cover 20 bear graphics 22 which would be visible from below and from the lower bunk.

Figure 3:
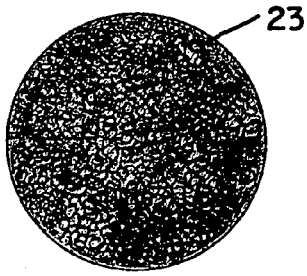
FIG. 3 is a perspective view of one gender of self-adhesive Hook and Loop element used to attach the cover under the upper bunk mattress.

FIG. 3 shows one gender 23 of self-adhesive Hook and loop fastener which would be used to fastening the cover 20 to the upper bunk 10. One side of the fastener has pressure sensitive adhesive covered by release sheet.

Figure 4:
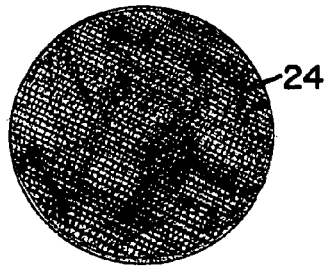
FIG. 4 is a perspective view of the other gender of self-adhesive Hook and Loop element used to attach the cover under the upper bunk mattress.

FIG. 4 shows the other gender 24 of self-adhesive Hook and Loop fastener which would be used to fastening the cover 20 to the upper bunk 10. One side of the fastener has pressure sensitive adhesive covered by release sheet.

Figure 5:
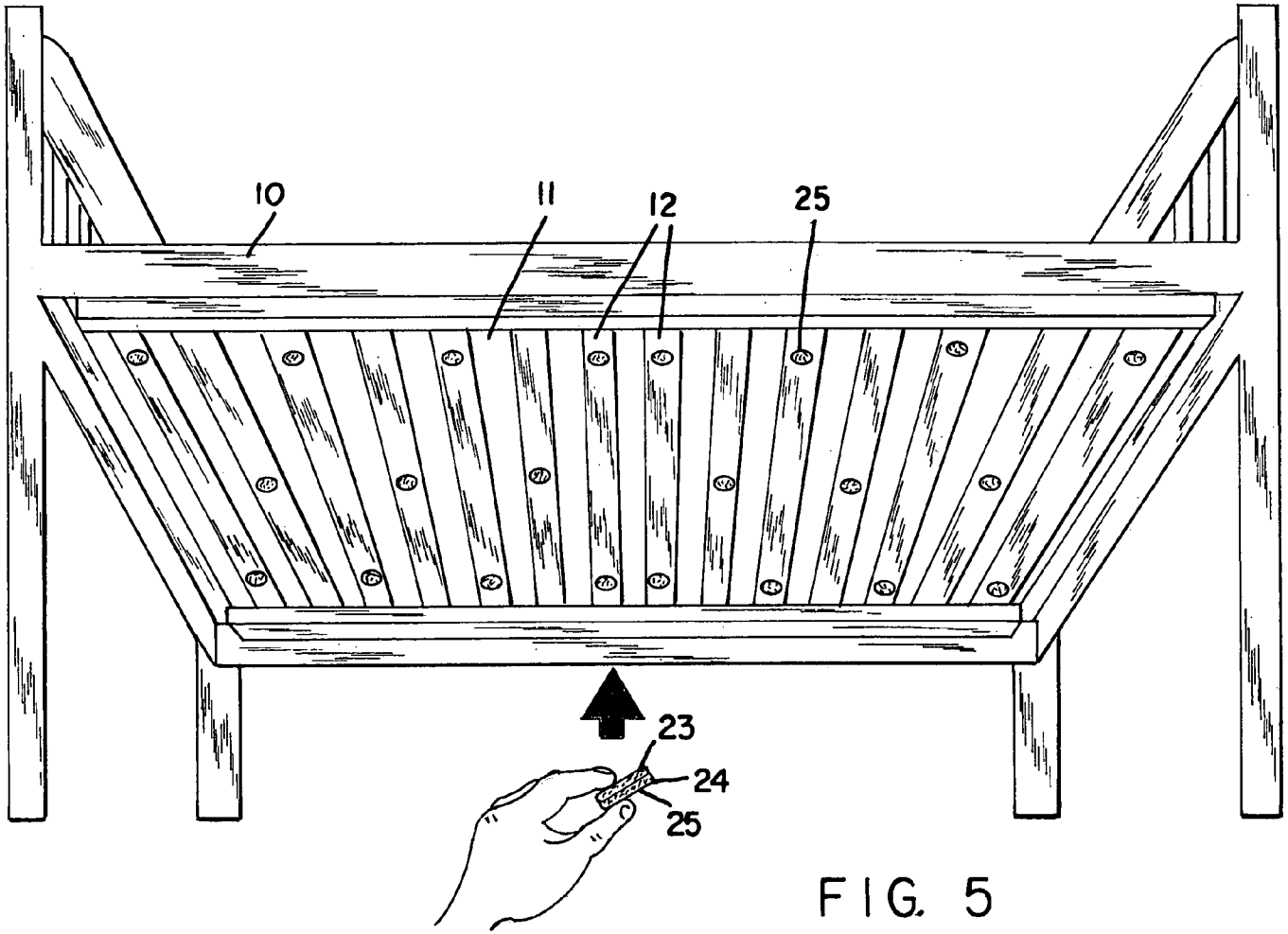
FIG. 5 shows the positioning of the Hook and Loop elements to the slats supporting the upper bunk mattress.

FIG. 5 shows the process by which the release paper is removed on each side of gender pairs 23 and 24 of self-adhesive Hook fastener pairs 25, and the pairs 25 are adhesively bonded to the structure of the upper bunk 10, and typically on the slats 12, with the second adhesive surface facing downward.

Figure 6:
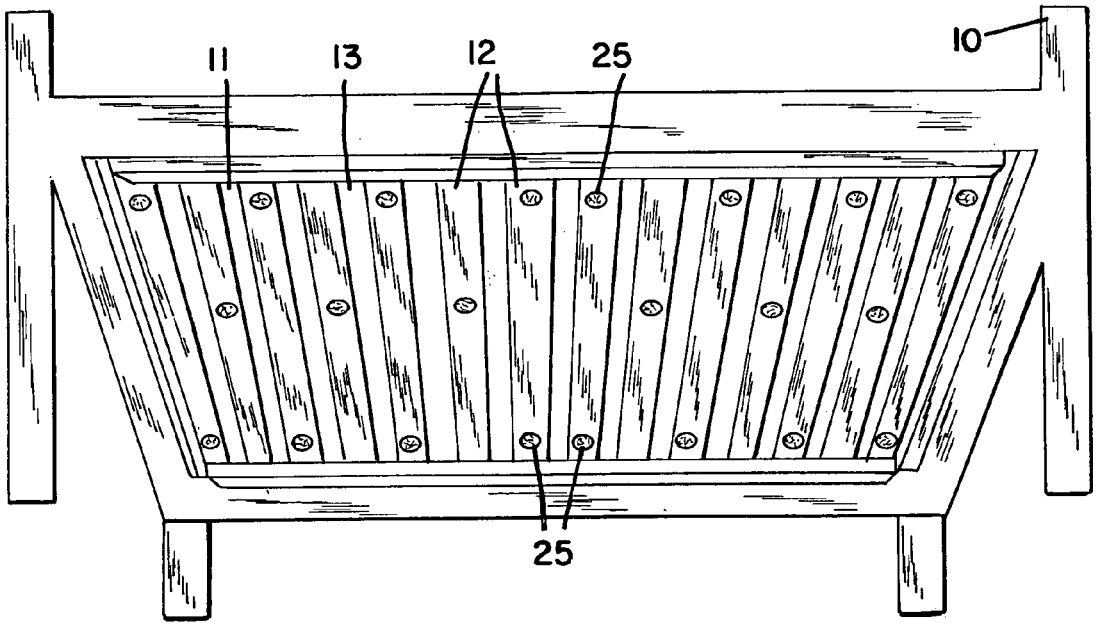
FIG. 6 shows the positioning of the cover to the positioned Hook and Loop elements to position the cover below the upper bunk mattress.
Figure 6:
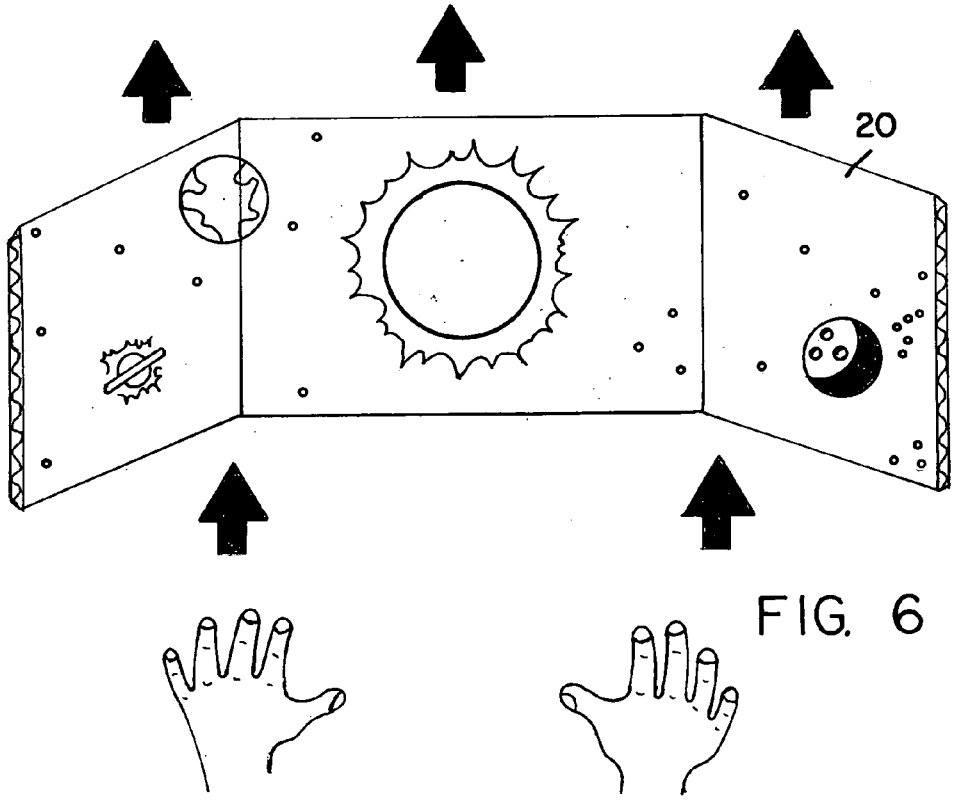
Figure 7:
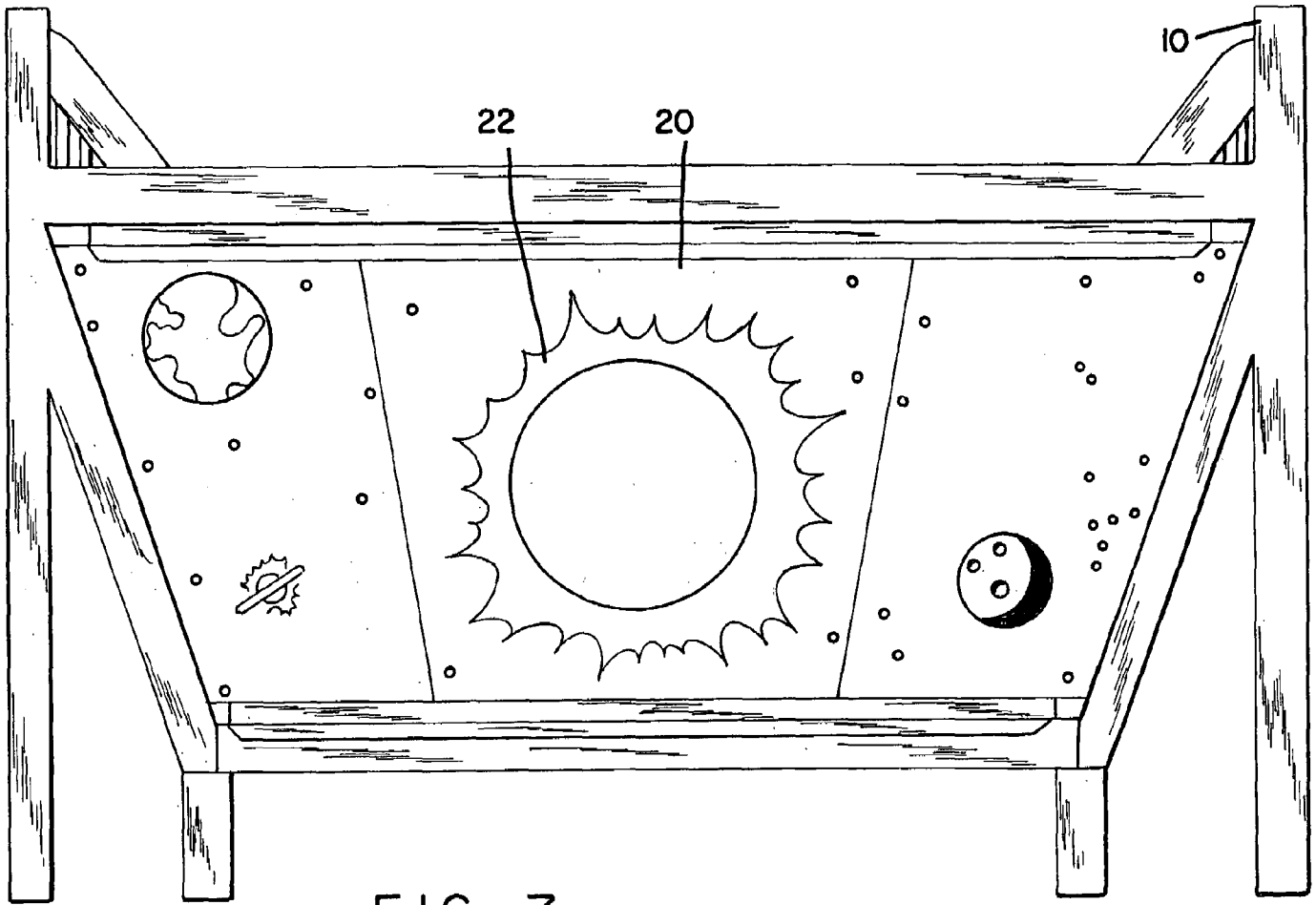
FIG. 7 is a perspective view showing the cover installed on the furnishing below the upper bunk mattress.

FIG. 6 shows the process by which the cover 20 is pressed upward against the Hook and loop fastener pairs 25 on the slats 12, so that the cover is adhesively bonded to the upper bunk and covers the lower surface 13 of the mattress 10, as shown in FIG. 7.

FIG. 7 shows the cover 20 bonded to the upper bunk 10 and covering the lower surface 13 of the mattress 10. Because the Hook and loop fasteners 23 and 24 can be reversibly separated, the cover 20 can be removed and reinstalled very easily. The cover 20 is installed with the graphics 22 facing down toward the occupant of the lower bunk.

In general, the current invention relates to a cover for the underside of a bunk or loft bed system or to be attached to the ceiling above the top bed. The cover is generally comprised of a frameless single continuous piece of rectangular plastic or suitable material 37" wide and 76" long, the typical width and length of standard bunk and loft systems. It will be no less than 2 mm thick and no more than 4 mm thick. The corners of the board will be rounded to avoid any possible injuries.

The cover may depict characters, designs, artwork, textures, photographs or any other desired designs imaged onto the board via current acceptable printing processes.

The purpose of the visual aspect of this invention is to possibly assist in the psychological disorder of claustrophobia, lulling sleep aid, study and educational aid, advertisement possibilities, aesthetic appeal, comfort environment for bed occupant, and cosmetic appeal for the actual bunk/loft bed assembly.

The purpose of plastic material usage involves a non-permeable barrier to common household dust mites and asthma/allergy/hay fever causing material that otherwise falls from the underside of the top bunk bed or loft bed.

The cover will be attached to the underside of the top bed or loft bed or ceiling by 24 individual 1⅞" Hook and Loop Coins or other suitable attachment methods.

The cover will be slit scored on the reverse image side in two places for foldable purposes to reduce the area size of the cover for convenience and transporting and storing the cover.

As seen in the foregoing description, this is an extremely simple, affordable and visually stimulating method to cover the underside of a top bunk or loft system or to be attached to the ceiling above the top bunk. The cover aids in visual aspects and health aspects of bunk and loft bed occupants as well. The detailed description above is to be taken in conjunction with the drawings in which was illustrated, by the way of example, the principles of the invention.

It is obvious that minor changes be made in the form and construction of the invention without departing from the material spirit thereof. It is not however, desired to confine the invention to the exact form herein shown and described, but it is desired to include all such as properly come within the scope claimed.

The invention having been thus described, what is claimed as new and desired to secure by Letters Patent is:

1. In conjunction with a bunk bed or loft bed assembly, a frameless furnishing, adapted to cover the bottom of the top bed of the bunk bed or loft bed assembly or attach to ceiling above top bed, said furnishing comprising:

a frameless single continuous piece of rectangular plastic or suitable material to form a cover assembly for the bottom of the top bunk or loft bed assembly or be attached to ceiling above top bed.

2. The furnishing of claim 1, wherein said cover assembly is irremovably attached to the bottom of the top bed or loft bed or be attached to ceiling above top bed.

3. The furnishing of claim 2, wherein said cover assembly is affixed to said bottom of the top bunk or loft bed assembly or ceiling above top bed by hook and loop elements.

4. The furnishing of claim 1, wherein said cover assembly can depict any visual or textural design.

5. The furnishing of claim 1, wherein said cover assembly has rounded corners to prevent injury.

6. The furnishing of claim 1, wherein said cover assembly is slit scored in one or more places for foldable purposes.

7. A method for substantially covering the lower surface of the mattress of an upper bunk bed, comprising adhesively mounting a cover to the upper bunk bed frame below the mattress.

8. A method as recited in claim 7, wherein adhesive elements are bonded to the upper bunk bed frame, and then the cover is adhesively bonded to the adhesive elements.

9. A method as recited in claim 8, wherein said adhesive elements are pairs of self-adhesive hook and loop fasteners.

10. A method as recited in claim 8, wherein said upper bunk bed has slats that support the mattress, and the adhesive elements are bonded to the slats.

* * * * *